US005596808A

United States Patent [19]

Lake et al.

[11] Patent Number: 5,596,808

[45] Date of Patent: Jan. 28, 1997

[54] SAFETY FOR KNIFE-BLADE LOCK

[76] Inventors: Ronald W. Lake, 3360 Bendix Ave., Eugene, Oreg. 97401; Michael L. Walker, 2925 Powell St., Eugene, Oreg. 97405

[21] Appl. No.: 496,842

[22] Filed: Jun. 28, 1995

[51] Int. Cl.[6] ..... B26B 1/04

[52] U.S. Cl. ..... 30/161; 30/160

[58] Field of Search ..... 30/160, 161; 7/118–120.

[56] References Cited

FOREIGN PATENT DOCUMENTS 1083893 1/1955 France ..... 30/161

*Primary Examiner*—Douglas D. Watts

*Attorney, Agent, or Firm*—Edward B. Anderson

[57] ABSTRACT

A knife has a folding blade, a blade lock in the form of a leaf spring, and a safety for preventing unlocking of the lock. One form of safety has a carrier in the form of an elongate arm mounted on the knife handle. A stud is positioned on an inside surface of one end of the arm. A contact surface is formed on an outside surface of the arm opposite from the stud. The other end of the arm is pivotably attached to the handle of the knife. The arm may be swung from a release position, unobstructive of the lock, to a safety position in which the presence of the stud prevents unlocking the lock. The carrier may be spring biased toward the release position, and may have limited travel away from the handle to the release position. The carrier may also be a slide or a rotating disk.

11 Claims, 2 Drawing Sheets

SAFETY FOR KNIFE-BLADE LOCK

BACKGROUND OF THE INVENTION

1. Field of the Invention

The present invention relates to the field of a lock for locking a knife blade in an open position, and more particularly to a safety for keeping such a blade lock in a locking position.

2. Description of Related Art

One form of conventional pocket knives are built with a handle and one or more folding blades. The blades in such knives are closed simply by pressing on the back of the blade and rotating the blade to a closed position in the knife handle. Such knives are known for their ability to close when being used if a pressure is inadvertently applied to the back of the blade.

In order to prevent this from happening, and thereby to allow use of both edges of the blade, locks were developed for locking a blade in an open position. This is commonly provided by a lock element that is spring biased to snap into position adjacent to the hinged end of the blade when the blade is opened. A projecting portion of the lock element or other release mechanism is manipulated to move the lock element away from the blade swing path so that the blade can be closed.

Folding knives having such locking blades have become common. However, because the lock feature is defeated by manipulation of an element on the knife handle, it is not unusual for the lock to be defeated inadvertently during use of the knife. If the person using the knife is unaware that the blade is unlocked, it can close unintentionally when a backward force is applied to the knife blade in what is intended to be a safe procedure.

The use of knives with locking blades has therefore not been met with universal acceptance because of the possibility of inadvertently defeating the locking feature during use.

SUMMARY OF THE INVENTION

The present invention overcomes this limitation of the prior art by providing a safety for the locking feature of a knife with a folding blade. Such a safety is selectively engageable for preventing movement of a lock element from a locking position. When such a safety is engaged, the knife blade will not inadvertently become unlocked with manipulation of the release element of the lock.

In general terms, then, the present invention provides a safety having a stud that is movable between a safety position in which the stud prevents movement of the lock from the lock position, and a release position in which the stud does not prevent movement of the lock from the lock position. The stud is mounted on a carrier, such as a member or bar, which is also referred to as a mounting means, that is movable in a way that moves the stud between the safety and release positions. An activation means, such as a lever or contact surface on the carrier, is coupled to the mounting means in a position exposed for manual movement of the carrier and the stud.

Various embodiments of the invention are possible, some of which are described below. These embodiments all function on a knife in which the lock is a finger biased like a leaf spring. The finger rides against the side of the blade when the blade is closed and moves in line with the blade when the blade is opened. In order to close the knife the finger must be moved from in line with the blade.

A safety made according to a first preferred embodiment of the invention has a carrier in the form of an elongate bar or arm mounted on the knife handle. A stud is positioned on an inside surface of one end of the safety arm. The contact surface is formed on an outside surface of the arm opposite from the stud. The other end of the arm is pivotably attached to the handle of the knife. A recess in the knife handle receives the safety when the stud is in either the safety position or the release position.

In another embodiment, the carrier slides in a slit in the handle between the safety and release positions. In yet another embodiment, the carrier is an arm pivotably attached to the handle, similar to the first embodiment. However, in this embodiment, the contact surface is close to the handle in the safety position and pivots away from the handle to the release position. A spring biases the carrier toward the release position. When a person grips the handle, the carrier is held in the safety position. This embodiment, as does the first embodiment, has the particular advantage of providing the user with the added safety of holding the safety in the safety position during use, preventing possible inadvertent release of the knife lock.

A final embodiment has a carrier in the form of a washer mounted on the blade hinge between the handle and blade. Rotation of the carrier moves a stud mounted on an outer edge of the carrier between the safety and release positions.

It will be appreciated that these safeties provide means for locking a blade lock in a locked position. This prevents inadvertent unlocking of the lock, particularly when the lock is designed to be unlocked by a simple movement relative to the handle. An appreciation of these and other features and advantages of the present invention and a more complete understanding of the invention may be achieved by studying the following description of the preferred embodiments and by referring to the accompanying drawings.

DESCRIPTION OF THE PREFERRED EMBODIMENTS

Figure 1:
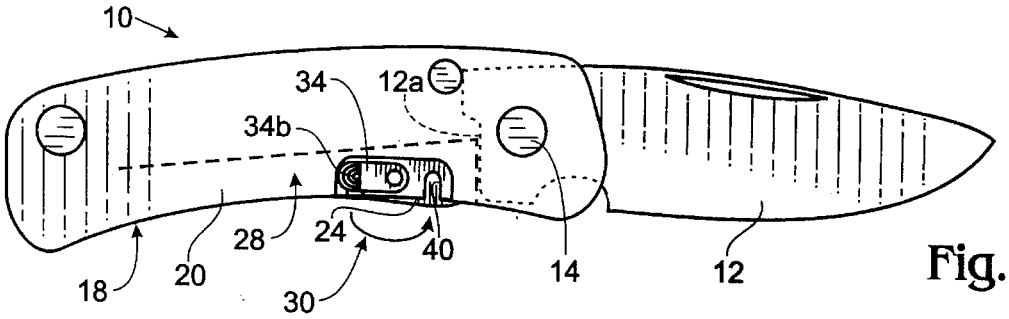
FIG. 1 is a side view of a knife having a safety made according to the invention, with the safety in a release position.
Figure 2:
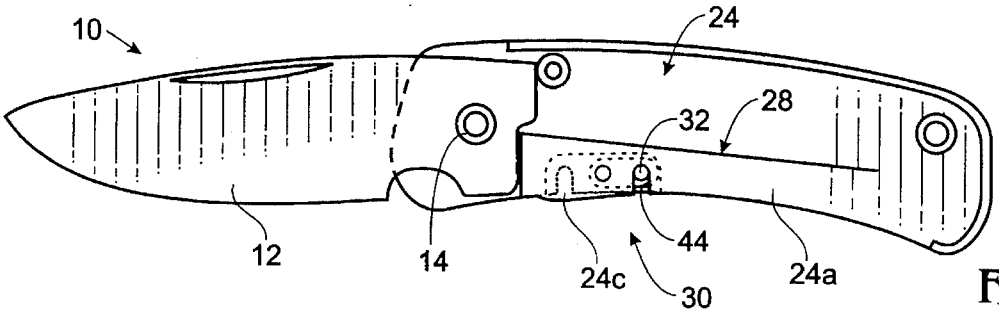
FIG. 2 is an inside view of the knife of FIG. 1 showing the side of the knife with the safety.
Figure 3:
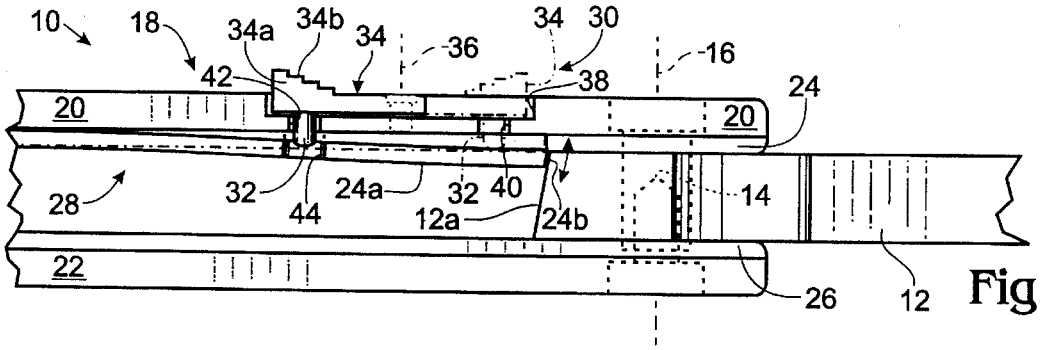
FIG. 3 is an enlarged fragmentary bottom view of the knife of FIG. 1 showing the blade, hinge, handle, lock, and safety.

As has been mentioned, the invention provides a safety for a knife having a folding blade and a lock that locks the blade in an open position. The safety secures the lock in the lock position. FIGS. 1–3 illustrate a knife 10 having a blade 12 that pivots about an axle or hinge pin 14 defining a blade axis 16 between open and closed positions. These figures show the blade in an open or unfolded condition.

A handle 18 that supports hinge pin 14 has outer side panels or frames 20 and 22, and associated liners 24 and 26. The liners in the form of plate elements conventionally were made of brass, but more recently are being made of titanium. The side of the handle seen in FIGS. 1 and 2 is referred to as the right side.

The hinge end of the blade opposite from the tip has a generally straight edge 12*a*. A lock 28 formed out of liner 24 consists of a finger 24*a* that is biased toward the blade, like a leaf spring. Finger 24*a* has an end edge 24*b* that conforms to blade edge 12*a*. When the blade is closed or in a folded position, finger 24*a* is flush against the side of the blade, in what is referred to as an unlocked position, and the blade is free to rotate. When the blade is pivoted to the fully open position, as is shown in the figures, the free end of finger 24*a* snaps into locking position in line with the blade with finger edge 24*b* adjacent to blade edge 12*a*.

Without moving finger 24*a* to the side of blade 12, the blade cannot be moved from the open position when the finger is in the locking position. Finger 24*a* typically also has an exposed region, such as region 24*c* that facilitates grasping the finger for movement out of the way when it is desired to return the blade to the closed position. It will be appreciated that if the handle is gripped in the hand of a person and the hand is moved around the handle in a way that moves the finger toward the unlocked position, lock 28 will be defeated and the blade would be free to close, possibly against the person's hand.

The description so far is of a conventional folding knife with a locking blade. In order to allow a person the option of securing the lock in the locking position, knife 10 is provided with a safety 30 made according to the invention. Safety 30 includes a stud 32 mounted to one end of an elongate arm 34. The other end of arm 34 is mounted to right side panel 20 of the handle for pivoting about a safety pivot axis 36. Since arm 34 in effect simply carries the stud between the safety and release positions, it is also referred to as a carrier. A recess 38 in the handle receives the arm so that the safety does not significantly alter the overall configuration or shape of the handle.

Figure 4:
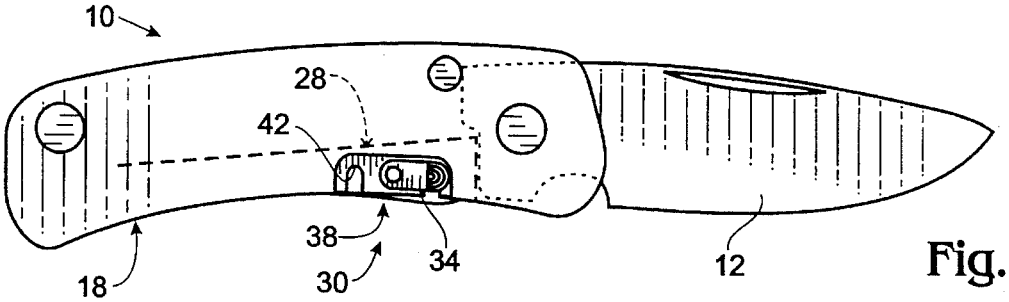
FIG. 4 is a view similar to FIG. 1 showing the safety in the safety position.
Figure 5:
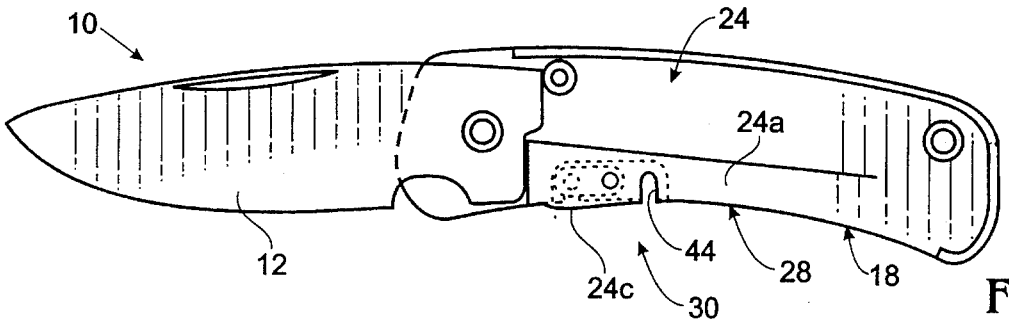
FIG. 5 is an inside view similar to FIG. 2 of the knife of FIG. 4.

Arm 34 pivots in a plane parallel to the blade. A first slot 40 exists in handle panel 20 in line with the position of the stud to allow the stud to reach the safety position, as represented by the position of the stud in dashed lines in FIG. 3 and as shown in FIGS. 4 and 5. Correspondingly, a second slot 42 also exists in panel 20 to accommodate the position of the stud in the release position, as is shown in FIGS. 1 and 2, and in solid lines in FIG. 3. In order to not interfere with the movement of the lock when the stud is in the release position, a slot 44, in line with slot 42, is also formed in the exposed edge of finger 24*a*. It also would be possible to change the size of the finger, or change the resting position of the stud.

A textured projection 34*a* has an exposed contact surface 34*b* that is opposite from stud 32 on arm 34. Projection 34*a* preferably extends slightly out beyond the surface of the handle to facilitate contact by the hand of a person manipulating the safety. Projection 34*a* is also referred to as manipulation means.

With the stud positioned in the release position, lock 28 is operable as it would be without safety 30. Thus, finger 24*a* can be moved from the locking position, shown in solid lines in FIG. 3, to the unlocked position, shown in dashed lines in the same figure. Blade 12 may then be folded closed.

The blade must be open and locked in order to engage safety 30. Arm 34 is pivoted about axis 36 until stud 32 rests in handle slot 40 with the head of the stud adjacent to the side of finger 24*a*. The finger is thereby prevented from being moved toward the unlocked position.

Safety 30 has the further advantage of being secure during use. That is, while the handle is being gripped by a person, the arm 34 is held in handle recess 38, thereby preventing inadvertent movement of the safety to the release position. Any force applied to grip region 24*c* will not cause it to move into the unlocked position due to the presence of the stud. This additional security in use of knife 10 is made possible by the fact that it is necessary to move the end of arm 34 having stud 32 away from the handle in order to change the position of the stud to the release position.

Figure 6:
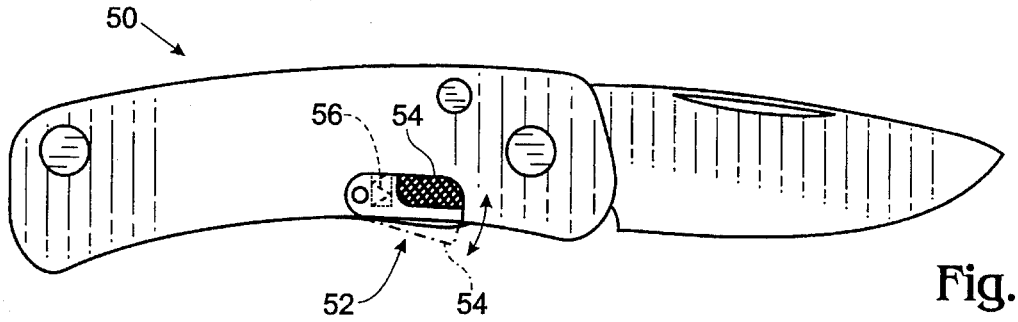
FIG. 6 is a side view of a knife having a second embodiment of a safety made according to the invention.
Figure 7:
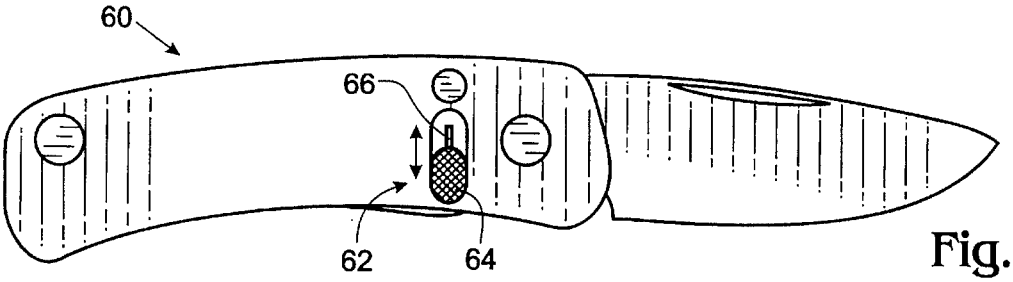
FIG. 7 is also a side view of a knife having yet another embodiment of a safety made according to the invention.
Figure 8:
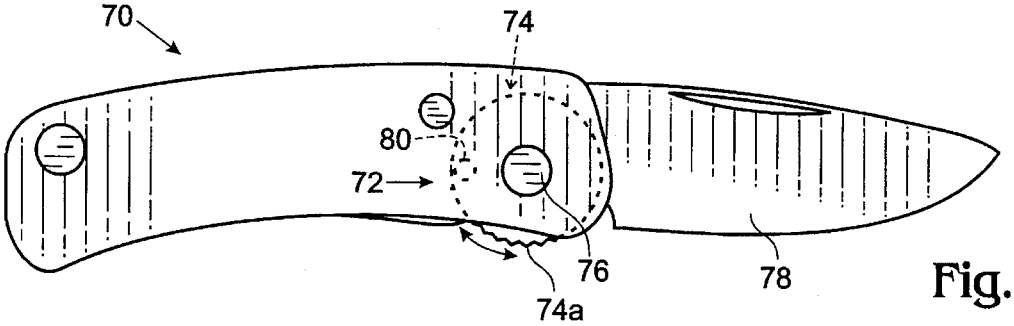
FIG. 8 is a side view of a knife having a fourth embodiment of a safety.

FIGS. 6, 7 and 8 illustrate knives having three different configurations of safeties but with locks that are substantially the same as lock 28. FIG. 6 shows a knife 50 in which a safety 52 is formed of an arm 54 similar to arm 34, except that the arm only pivots a few degrees away from the safety position, to a release position, such as the position shown in dashed lines. A spring 56 biases the arm toward the release position away from the knife. When in the release position, then, the arm extends away from the knife and may interfere somewhat with its use. However, as with safety 30, when the handle is gripped with the blade open, the safety is forced into and held in the safety position. There is thereby no chance for the blade to become unlocked while the handle is firmly gripped.

The knife 60 shown in FIG. 7 has a safety 62 that is in the form of a button 64 that is captured in and slides in a slit 66 between the safety and releasing positions. This embodiment has the advantage of being readily operated with a simple movement of a thumb or finger while the knife is being held, although there is more chance that the position of the safety may be changed inadvertently.

A final embodiment of a knife 70 with a safety 72 made according to the invention is shown in FIG. 8. This safety is in the form of a disk or washer 74 that pivots about a hinge pin 76 between a blade 78 and liner, not shown. Washer 74 pivots coaxially with but independently from the blade. An exposed textured perimeter region of the washer forms a contact surface 74*a* for manipulating the rotational position of the washer. A stud 80 is mounted on the washer as shown. Rotation of the washer by a thumb or finger moves the stud between safety and release positions, similar to movement of the stud in the embodiment of FIG. 7. This embodiment has the simplicity of using the knife hinge pin to provide the operating structure for movement of the stud.

It is therefore seen that a safety made according to the invention provides means for preventing unlocking of a blade lock. Different embodiments provide different benefits, such as ease of use, ease of manufacture, and secure functioning of the safety by the gripping of the knife handle. Such a safety can be provided for a knife having a blade lock that moves between locking and unlocked positions. Movement of the stud or blocking element in the safety may be provided by various means, such as a pivoting or sliding arm or rotating disk. A lever action could also be provided. The stud, carrier and contact surface can all be part of a single element or be different parts joined or coupled together using mechanical means. Thus, although the present invention has been described in detail with reference to particular preferred embodiments, persons possessing ordinary skill in the art to which this invention pertains will appreciate that various modifications and enhancements may be made without departing from the spirit and scope of the claims. The above disclosure is thus provided for purposes of illustration and is not limitation.

What is claimed is:

1. A knife comprising:

a handle;

a blade mounted for pivoting relative to the handle about a first axis between a closed position and an open position;

a leaf-spring having a lock element biased against the blade when the blade is in the closed position, for moving to a lock position in line with the blade when the blade is opened for preventing pivoting of the blade from the open position toward the closed position, the lock element being movable between the lock position in which the blade in the open position is prevented from pivoting and an unlock position in which the blade in the open position is allowed to pivot and a safety comprising:

a stud;

means mounting the stud relative to the knife for movement relative to the lock element between a safety position in which the stud prevents movement of the lock element from the lock position, and a release position in which the stud allows movement of the lock element from the lock position; and.

manipulation means coupled to the mounting means in a position exposed for manual contact by a person for moving the stud between the safety position and the release position.

2. A safety according to claim 1 wherein the mounting means comprises a member mounted for pivoting relative to the lock element about a second axis and the stud is mounted on the member spaced from the second axis.

3. A safety according to claim 2 wherein the member is mounted to the handle.

4. A safety according to claim 2 wherein the second axis is coaxial with the first axis.

5. A safety according to claim 4 further comprising an axle defining the first and second axes.

6. A safety according to claim 2 wherein the manipulation means is spaced from the handle when the safety is in the release position and the manipulation means is movable toward the handle for moving the stud toward the safety position, whereby a person gripping the handle also holds the stud in the safety position.

7. A safety according to claim 6 further comprising biasing means for urging the stud toward the release position.

8. In a knife having a handle, a blade mounted for pivoting relative to the handle about a first axis between a closed position and an open position, and a spring-activated lock for preventing pivoting of a blade from the open position toward the closed position, the lock being movable between a lock position in which a blade in the open position is prevented from pivoting and an unlock position in which a blade is allowed to pivot, a safety comprising:

a stud;

means mounting the stud relative to the knife for movement relative to the lock between a safety position in which the stud prevents movement of the lock from the lock position, and a release position in which the stud allows movement of the lock from the lock position;

biasing means for urging the stud toward the release position; and manipulation means coupled to the mounting means in a position exposed for manual contact by a person for moving the stud between the safety position and the release position.

9. In a knife having a handle, a blade mounted for pivoting relative to the handle about a first axis between a closed position and an open position, and a spring-activated lock for preventing pivoting of a blade from the open position toward the closed position, the lock being movable between a lock position in which a blade in the open position is prevented from pivoting and an unlock position in which a blade is allowed to pivot, a safety comprising:

a stud;

means mounting the stud relative to the knife for movement relative to the lock between a safety position in which the stud prevents movement of the lock from the lock position, and a release position in which the stud allows movement of the lock from the lock position; and manipulation means coupled to the mounting means in a position exposed for manual contact by a person for moving the stud between the safety position and the release position, the manipulation means being positioned close to the handle when the stud is in the safety position and being movable away from the handle for moving the stud toward the release position, whereby a person gripping the handle also holds the stud in the safety position.

10. A knife comprising:

a handle;

a blade mounted for pivoting relative to the handle about a first axis between a closed position and an open position;

a leaf-spring having a lock element biased against the blade when the blade is in the closed position, for moving to a lock position in line with the blade when the blade is opened, the lock element being movable between the lock position in which the blade is locked in the open position and an unlock position in which the blade in the open position is allowed to pivot; and a safety having a safety position in which the lock element is prevented from being moved from the lock position and a release position in which the lock element is allowed to be moved from the lock position, the safety being movable between the safety position and the release position, the safety comprising a stud and an exposed contact surface, the safety being mounted adjacent to the handle for movement of the stud, by manual movement of the contact surface, between the safety position and the release position.

11. A knife according to claim 10 wherein the contact surface is positioned close to the handle when the safety is in the safety position and the contact surface is movable away from the handle for moving the stud toward the release position, whereby a person gripping the handle also holds the stud in the safety position.

* * * * *